US006841129B2

(12) United States Patent
Braun et al.

(10) Patent No.: US 6,841,129 B2
(45) Date of Patent: Jan. 11, 2005

(54) LIQUID DISPENSING AND/OR ASPIRATING DEVICE TO BE OPERATED MANUALLY REPEATEDLY

(75) Inventors: Ralf Braun, Kreuzwertheim (DE); Peter Mahler, Kreuzwertheim (DE); Jürgen Schraut, Waldbüttelbrunn (DE)

(73) Assignee: Brand GmbH + Co KG, Wertheim (DE)

( * ) Notice: Subject to any disclaimer, the term of this patent is extended or adjusted under 35 U.S.C. 154(b) by 475 days.

(21) Appl. No.: 09/919,944

(22) Filed: Aug. 2, 2001

(65) Prior Publication Data

US 2002/0018734 A1 Feb. 14, 2002

(30) Foreign Application Priority Data

Aug. 3, 2000 (DE) ..... 100 38 569

(51) Int. Cl.[7] ..... B01L 3/02; B65B 43/42; B67D 5/08

(52) U.S. Cl. ..... 422/100; 73/863.32; 73/864; 73/864.01; 73/864.02; 141/130; 222/52; 222/63; 222/639

(58) Field of Search ..... 422/100, 105, 422/107–108, 922, 925; 73/863.32, 864, 864.01, 864.11, 864.16, 864.04; 141/130, 153, 156, 157; 222/30, 52, 63, 639, 641, 642

(56) References Cited

U.S. PATENT DOCUMENTS

| | | | | | |
|---|---|---|---|---|---|
| 3,622,279 | A | * | 11/1971 | Moran | 422/65 |
| 3,887,110 | A | * | 6/1975 | Porter | 222/16 |
| 3,951,605 | A | * | 4/1976 | Natelson | 422/65 |
| 4,077,395 | A | * | 3/1978 | Woolner | 600/575 |
| 4,078,895 | A | * | 3/1978 | Moran | 422/66 |
| 4,199,013 | A | * | 4/1980 | Reich et al. | 141/130 |
| 4,779,467 | A | * | 10/1988 | Rainin et al. | 73/964.17 |
| 4,905,526 | A | * | 3/1990 | Magnussen, Jr. et al. | 73/864.18 |
| 5,576,503 | A | * | 11/1996 | Nabity et al. | 73/863.01 |
| 6,254,832 | B1 | * | 7/2001 | Rainin et al. | 422/100 |
| 6,299,841 | B1 | * | 10/2001 | Rainin et al. | 422/100 |
| 6,592,825 | B2 | * | 7/2003 | Pelc et al. | 422/100 |
| 6,599,476 | B1 | * | 7/2003 | Watson et al. | 422/63 |
| 2001/0055547 | A1 | * | 12/2001 | Rainin et al. | 422/100 |

FOREIGN PATENT DOCUMENTS

| | | |
|---|---|---|
| DE | 44 36 595 A1 | 4/1995 |
| DE | 195 13 023 C2 | 10/1996 |
| WO | WO 00/51738 | 9/2000 |
| WO | WO 00/51739 | 9/2000 |

OTHER PUBLICATIONS

Compudil, Apr. 12, 1984, 5 Pages.
Eppebdorf, Dec. 4, 1998, 4 Pages.

* cited by examiner

*Primary Examiner*—Jill Warden
*Assistant Examiner*—Brian R. Gordon
(74) *Attorney, Agent, or Firm*—Nixon Peabody LLP; David S. Safran

(57) ABSTRACT

A liquid dispensing and/or aspirating device to be operated manually repeatedly, having a controlling device, a motor drive, control electronics, a manually actuatable actuating element, and a programming element, where the quantity of liquid which is conveyed by motor on actuation of the actuating element is adjusted in the control electronics by the programming element. A process interval ($t_p$) for a plurality of process steps to be carried out in succession is stored in the control electronics. A first type of actuation of the actuating element triggers an individual process step, while a second type of actuation automatically results in repeated successive triggering of process steps, each in the process interval ($t_p$). Handling of the device in practice is greatly improved by the fact that the process interval ($t_p$) is automatically determined by the control electronics by analyzing the interval(s) occurring between the individual actuations of the actuating element.

26 Claims, 4 Drawing Sheets

LIQUID DISPENSING AND/OR ASPIRATING DEVICE TO BE OPERATED MANUALLY REPEATEDLY

BACKGROUND OF THE INVENTION

1. Field of the Invention

The present invention relates to a liquid dispensing and/or aspirating device that is operated manually.

2. Description of Related Art

Dispensing devices relevant to the present invention include pipette systems with repeating pipettes operated by direct displacement (positive displacement pipette) or displacement with a cushion of air (air displacement pipette), or metering devices of a metering system operating with positive displacement or air displacement.

Manually operated repeating pipettes are pipettes which are operated by hand and are connected to a large-volume syringe from which a small partial amount can be metered into a receiving container by operation of the actuating element. Repeating pipettes are used for series tests, especially in conjunction with a plurality of receiving containers, often with so-called titration plates.

There are manually operated repeating pipettes in which a plunger adjusting device is operated by stepping mechanics and the plunger in the syringe is displaced to the desired specific extent in each metering step. Conventional volumes to be pipetted, i.e., metered amounts, would be e.g. 100 $\mu$to 500 $\mu$l, where a typical syringe has a filling volume which corresponds to 10 to 100 times the desired metering amount.

However, an more advantageous repeating pipette is operated by an electric motor where the electric motor drive is controlled by operation of the actuating element on the pipette housing, and the plunger adjusting device is moved to the desired extent. A repeating pipette operated by an electric motor is especially convenient to operate because of the electric motor drive. The control electronics provided to control the electric motor drive offer the possibility of not only accurately preselecting the metered quantity, but also preselecting a metering interval for a plurality of metering operations of identical metered amounts to be carried out in succession. Therefore, in such a repeating pipette (positive displacement) which is known from practice, the desired metering interval is adjusted in an adjustment range from 0.1 to 1.0 sec by means of programming keys on the programming element, adjustment increments of 0.1 sec being possible. In another system known from practice, a repeating pipette designed as an air displacement pipette is provided, and a metering interval between 0.1 sec and 10.0 sec can be entered for this pipette.

If an operating person has the impression from previous activity that a metering interval of 0.4 sec is feasible for example, then this operating person will set this metering interval by means of the programming element. If the operating person then begins the metering, the operating person can keep the actuating element continuously in operation after the start of the metering cycle. The individual metering operations then take place automatically at intervals according to the adjusted metering interval, i.e., at an interval of 0.4 sec, in this example. The operating person then needs only be sure to always move the repeating pipette over a new receiving vessel in this cycle. This eliminates individual operation of the actuating element which would otherwise be necessary to trigger the individual metering operation. This greatly increases working speed.

Similar issues and concerns such as those encountered with repeating pipettes also occur in general with metering equipment that is operated by electric motor but is actuated by hand when repeated automatic metering operations are to be carried out with the metering device. In this regard, reference is made to the German patent DE 195 13 023 C2 which shows the state of the art for metering devices. They are known in particular as bottle metering devices or bottle titraters. In addition, as already indicated above, a similar issues and concerns also arises with manually operated aspirating devices for liquids and combined devices which combine liquid aspiration and dispensing functions.

A pipetting device having a memory function is known, for example, from the German application DE 44 36 595 A1. This pipetting device has a programming element which can assume a manual position, a memory setting position and a memory operating position. If the programming element is in the memory setting position, actuation of the actuating element results in the fact that a storage volume, which is determined by the operating person, can be aspirated (or dispensed). This storage volume, which is predetermined by the operating person, is then stored in the memory in the control electronics. Then if the programming element is switched to the memory operation position, subsequent manual actuation of the actuating element results in automatic dispensing (or aspiration) of a quantity of liquid of the amount stored previously. Actuation of the actuating element then serves only to trigger the dispensing step or the aspiration step but not to determine its duration.

There is also a repeating pipette operated by electric motor disclosed in the International applications WO 00/51739 A and WO 00/51738 A which has an especially ergonomically advantageous arrangement of actuating elements near a display. However, these references fail to disclose details regarding the functioning with regard to receiving and dispensing partial quantities of liquid.

Finally, there is also a known repeatedly actuated metering device as disclosed in the "Compudil" brochure dated Apr. 12, 1984 which can be programmed in various programs by a programming device. With regard to dispensing partial quantities of liquid, the functioning corresponds to that of the pipetting device described previously.

With the prior art described above, the individual process step is triggered by manual actuation of the actuating element. However, these references do not disclose automatic repeated successive triggering of process steps in a certain preadjustable process interval. In this regard, there is an unfulfilled need for a dispensing and/or aspirating device for liquids that allows automatic repeated successive triggering of process steps in the certain preadjustable process interval.

SUMMARY OF THE INVENTION

The primary object of the present invention is to provide a dispensing and/or aspirating device for liquids of the type discussed, which is further improved with regard to handling.

It has been found that in practice, the automatic function described above with the known repeating pipette operated by electric motor is not used as often as one would assume. The difficulty is probably that the operating person cannot reliably predict how long the metering interval should be to correspond to personal specifics. Even the same operating person may have a different rhythm between one day and the next. Depending on stress levels and fatigue, it may be either easier or more difficult for an operating person to find his or her rhythm corresponding to the metering interval set in the control electronics. In addition, the metering interval is often not adjusted out of convenience. In fact, when an operating person notices that he cannot properly keep up with the set metering interval, he will usually return to individual metering operations by actuating the actuating element.

One aspect of the present invention includes the provision of the control electronics which is a self-learning system. Because it is a self-learning system, the control electronics does not require presetting of the process interval by the operating person. Instead, the operating person need only begin with the handling in the form of individually triggered process steps and continue until the operating person has found his or her personal rhythm at that time. Then, if the operating person changes from the first type of actuation of the actuating element to the second type of actuation of the actuating element, the control electronics automatically continues the process steps with the process interval which is derived from the intervals of the preceding individual process steps.

The above-mentioned self-learning function of the control electronics result in the process interval being adapted to the rhythm of the operating person, not vice versa. Acceptance of using this function is thus, very high with the device according to the present invention. It has been found that working speed is much higher with the device according to this invention.

The teaching of this invention is explained further below on the basis of a dispensing device for liquids with which a certain metered amount can be metered into a receiving vessel by a motor drive through the actuation of the actuating element. However, notwithstanding the specific example, the general applicability of the device according to this invention for handling liquids, as mentioned repeatedly above, holds for all methods of dispensing and/or aspirating liquids.

The concept of actuation of the actuating element is to be understood in general terms. For example, in the case of an actuating element designed as a pushbutton, it should include the normal case where depressing the actuating button corresponds to actuation. On the other hand, with a corresponding design of the control electronics, releasing the actuating button should fulfill the function of actuation of the actuating element in other embodiments. Thus, the actuating element would be kept depressed during the individual metering operations and be released only briefly for the individual metering operation, then released continuously for continuous actuation. In addition, a double button would also be conceivable as an actuating element, with one button for a single metering operation and a second button for an automatic metering operation. Further actuation can be attained and described using the computer mouse analogy with a single actuation (single click) for a single operation and double actuation (double click) for continuous operation.

Finally, electronic actuating elements instead of mechanical actuating elements may be used where actuation is equivalent to inducing operation or not inducing operation. For example, capacitive proximity switches etc., may be considered as actuating elements. Optical actuating elements, e.g., a photoelectric barrier switch, are also especially advantageous.

In the above regard, for clarification purposes, the following definitions are given for the following terminology:

The "trip interval" is the interval between the start of actuation of the actuating element and the start of the next actuation of the actuating element. This is referred to hereinbelow as the interval between individual actuations of the actuating element.

The "process interval" is the period of time between the start of one process step and the start of the following process step.

The "resting interval" is the period of time between the end of one process step and the beginning of the following process step.

These and other advantages and features of the present invention will become more apparent from the following detailed description of the preferred embodiments of the present invention when viewed in conjunction with the accompanying drawings.

DETAILED DESCRIPTION OF THE PREFERRED EMBODIMENT

The teaching of this invention relates in general to the handling of liquids. This may involve first dispensing liquids by a corresponding dispensing device in a metered manner from a larger volume of liquid taken up previously or from a volume of liquid stored otherwise. However, this may also involve the controlled aspiration of partial quantities of liquid from a volume of liquid. In addition, this may also involve a combination of both methods, i.e., both aspiration and dispensing of partial quantities of liquid. The latter may also take place in a repeating cycle of aspirating/dispensing aspirating/movement/dispensing. In this regard, it should be noted that the teaching of the present patent application herein is described as primarily applied to dispensing devices. This provides a simpler understanding of the functioning of the device described herein. However, the present invention is not limited thereto and the teaching of the present patent application can be used for all types of handling of liquids in aspiration and/or dispensing of liquids.

Moreover, as previously noted, the following definitions are given for the following terminology used herein:

The "trip interval" is the interval between the start of actuation of the actuating element and the start of the next actuation of the actuating element. This is referred to hereinbelow as the interval between individual actuations of the actuating element.

The "process interval" is the period of time between the start of one process step and the start of the following process step.

The "resting interval" is the period of time between the end of one process step and the beginning of the following process step.

Figure 1:
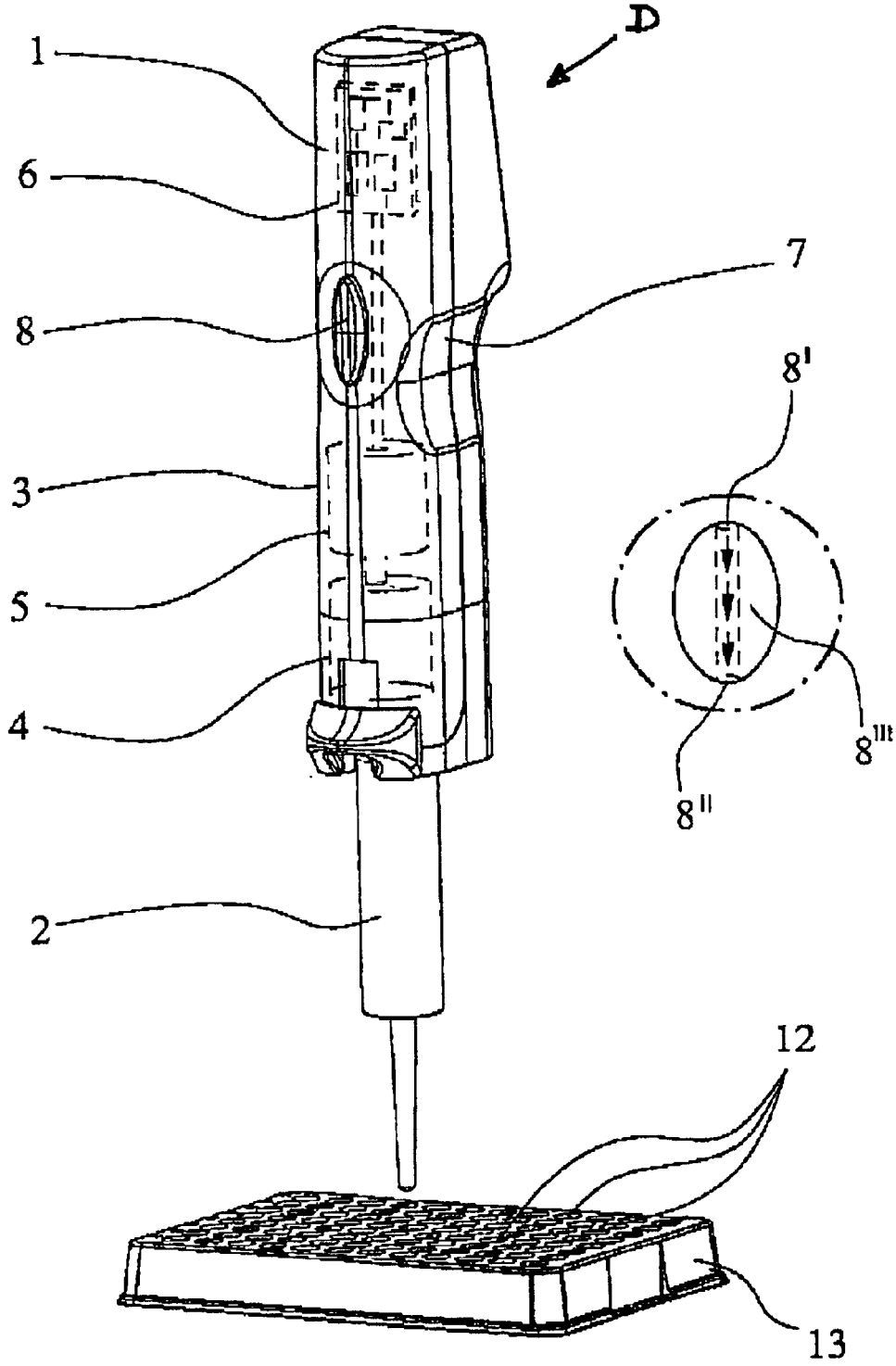
FIG. 1 shows a perspective view of the preferred embodiment of a dispensing device in accordance with the present invention including a repeating pipette and a syringe connected thereto above an arrangement of receiving vessels, namely a titration plate.
Figure 2:
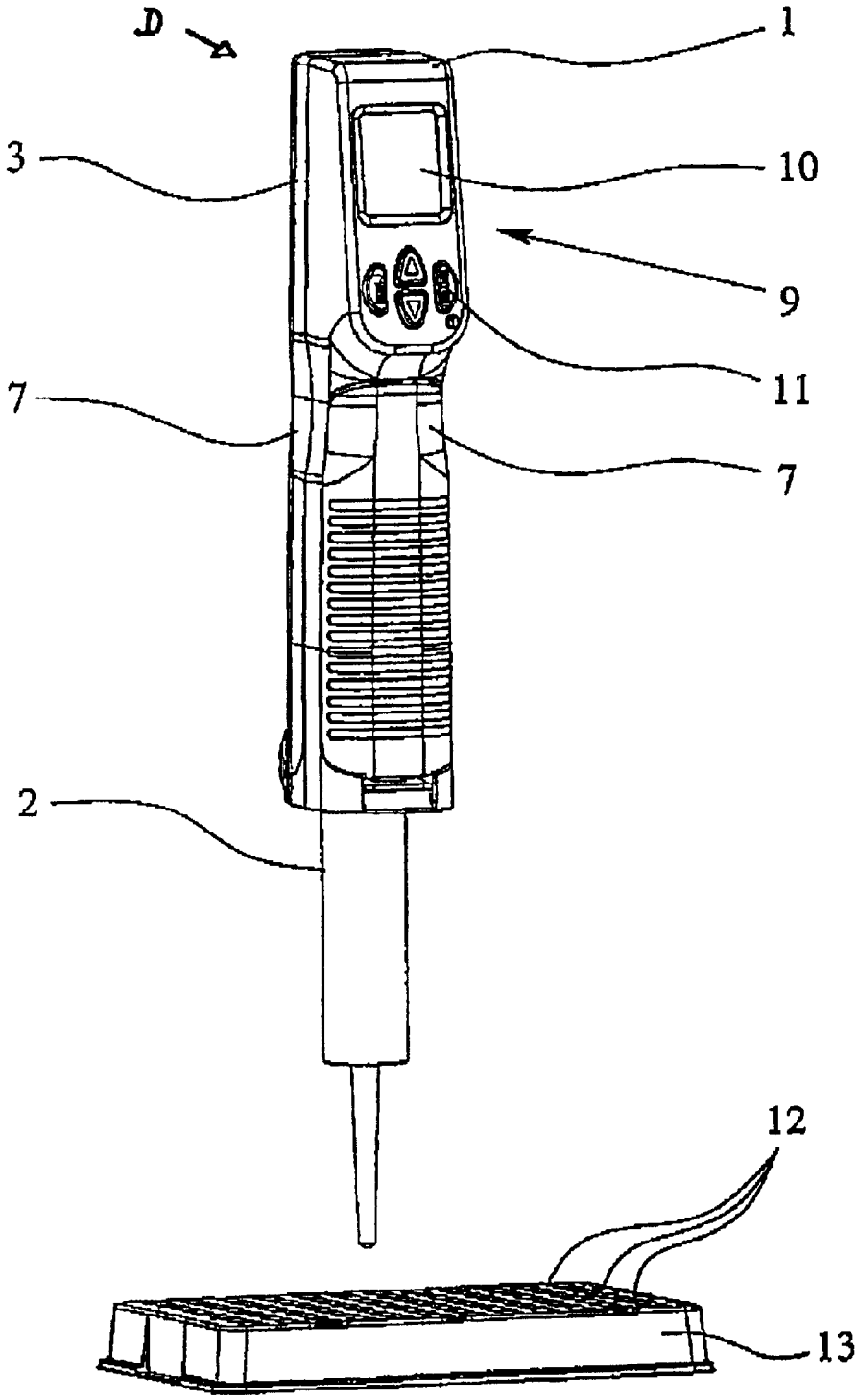
FIG. 2 shows the dispensing device of FIG. 1, the housing seen from an opposite side.
Figure 3:
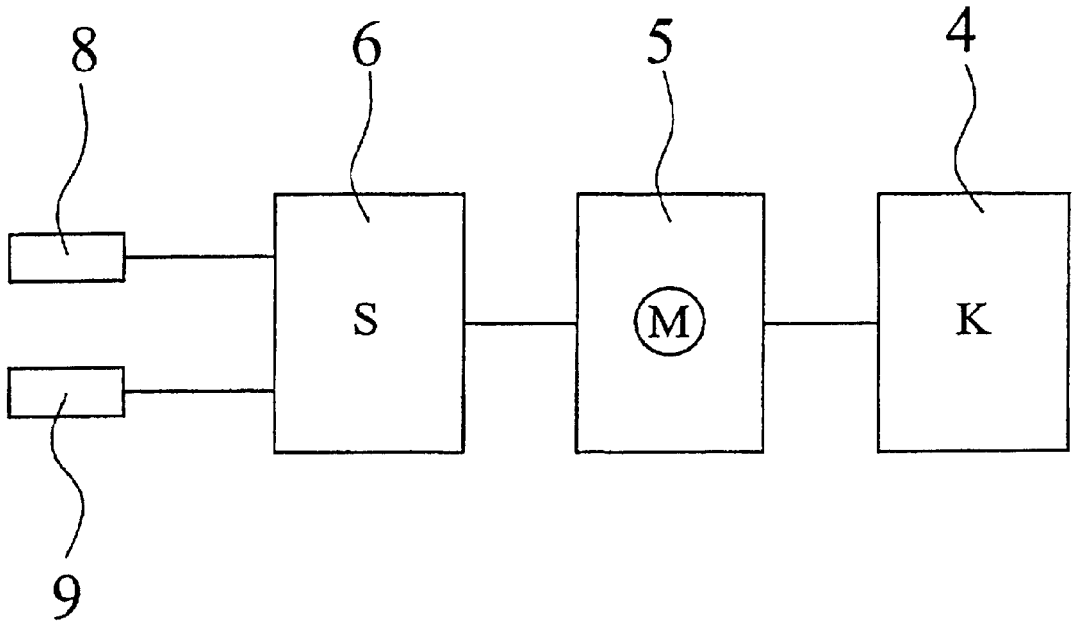
FIG. 3 shows a block diagram of the dispensing device according to one embodiment of the present invention.

The device illustrated in FIGS. 1 and 2 is a dispensing device D in the form of a repeating pipette 1, which is intended for a manually operated pipetting system having such a repeating pipette 1 and a syringe 2 which is mounted interchangeably thereon. The syringe 2 has a filling volume large enough that small metered amounts can be delivered from this syringe 2 into a plurality of receiving vessels in a plurality of individual steps as described below. FIG. 3 shows the principle of the dispensing device D in the form of repeating pipette 1 according to the present invention as a block diagram. FIG. 3 should also be consulted for an understanding of the explanation of FIGS. 1 and 2.

The dispensing device D according to the illustrated embodiment of the present invention includes repeating pipettes 1 in the form of positive displacement pipettes, air displacement pipettes, or metering devices such as bottle dosers or bottle titraters. The dispensing device is explained below by the example of a repeating pipette 1 in the form of a positive displacement pipette. However, the present invention is not limited thereto and may be applied dispensing devices having pipettes and/or other metering devices. In this regard, the applications discussed previously regarding dispensing and/or aspirating liquids are applicable in the present invention and "Compudil", which is described in the publication cited above, is an example of a steady-state metering device.

Dispensing device D in the form of repeating pipettes 1 shown has a housing 3 which in the illustrated embodiment, is a pipettee housing, and a controlling device 4 therein. In the embodiment where the dispensing device D includes a repeating positive displacement pipette, the controlling device 4 would be a plunger controlling device with which a plunger (not shown) of the syringe 2 can be advanced incrementally for the purpose of a single metering operation of a certain metering amount. An electric motor drive 5 used for actuation of the controlling device 4 is, in turn, controlled by control electronics 6. Other motor drives may also be used, but an electric motor drive 5 is especially suitable for practical purposes.

FIG. 1 shows handle recesses 7 on the housing 3 for secure gripping of repeating pipette 1, as well as an actuating element 8, which is actuable by hand by an operating person who holds the repeating pipette 1 to trigger the dispensing of the liquid. In the embodiment illustrated, this actuating element 8 is in the form of an actuating button. However, other actuating elements 8 such as an actuating rocker switch or the like may also be used. The actuating element 8 is used to actuate the control electronics 6. When actuated, the electric motor drive 5 is controlled briefly by the control electronics 6 and produces the desired adjustment of the controlling device 4. However, in other embodiments, the actuating element 8 may be a purely electronic element such as proximity-type element instead of a mechanical element. For instance, the actuating element may be designed as a capacitive proximity switch, a stray field sensor, or be an optoelectronic actuating element such as a photoelectric barrier or a reflection sensor.

The diagram inside the dotted outline at the right of FIG. 1 shows an actuating element operating based on such optoelectronic principles. Depressing a cover plate 8''' causes the photoelectric barrier to be interrupted which serves as the actuation signal of the actuating element. Such a signal is more expedient to handle in the control electronics 6, because a defined trigger level can be preset. On the other hand, mechanical switches, tend to rebound. This rebound must be taken into account through an appropriate algorithm in the software of the control electronics 6. This necessitates calculating into it a certain minimum waiting time during which the actuating element is completely "insensitive". This minimum waiting time together with the minimum trip time represents a lower limit for the trip interval and thus, for the process interval. One would, of course, like to set this lower limit as low as possible.

Furthermore, a programming element 9 for the control electronics 6 is also provided on the housing 3. In the embodiment shown, the programming element 9 is on the side of the housing 3 opposite the actuating element 8. In the embodiment illustrated, the programming element 9 for the control electronics 6 has a display surface in the form of a display 10 and several programming keys 11. It should be noted that it is important only that programming element 9 be provided. The design and details of the programming element 9 can be readily determined by one of ordinary skill in the art based on the technical knowledge. Beneath the repeating pipette 1, multiple receiving vessels 12 can be seen in FIGS. 1 and 2. In the illustrated embodiment, the multiple receiving vessels 12 are combined in an 8×12 (96) titer plate 13. Here again, many different variations are of course possible.

The control electronics 6 of the repeating pipette 1 is adapted to provide a certain metered quantity, which here amounts to a fraction of the filling volume of syringe 2. The metered quantity can be adjusted via the control electronics 6 using the programming element 9, the amount being automatically metered from the syringe 2 into a receiving vessel 12 with each actuation of the actuating element 8. This is a characteristic function of the repeating pipette 1. This function can essentially also be achieved with different metered amounts. The same also applies to a dispensing device D in the form of a metering device.

It is also important that the control electronics 6 can set and/or store the process interval so that at least one process interval for a plurality of process steps to be carried out in succession. In the present example, this process interval is an interval for a plurality of metering operations to be carried out in succession. In accordance with the teachings of the present invention, the process step may also include several individual steps, e.g., a sequence of an aspirating step, a transport step and a dispensing step. In the present embodiment, the dispensing metering step is described in further detail below.

A first type of actuation of the actuating element 8, namely a short-term actuation of the actuating element 8 in the illustrated embodiment, results in triggering an individual, single metering operation. A second type of actuation of the actuating element 8, namely continuous actuation of the actuating element 8 in the embodiment shown here, causes automatic, repeated triggering of the metering operations in the process interval $t_p$. In the present technique, the important point is how the process interval $t_p$ is determined. In the state of the art, the process interval $t_p$ is set at a value of 0.4 sec by means of the programming element 9. Adjusting increments of 0.1 sec to 1.0 sec, each in 0.1 sec intervals, are available for setting the process interval. Alternatives to this have already been described in the general part of the description.

The dispensing device D in accordance with the illustrated embodiment is characterized in that the process interval $t_p$ is determined by the control electronics 6 itself by analyzing the interval(s) between individual actuation of the actuating element 8 occurring during the previous individual or multiple individual trips of a process step. Thus, the control electronics 6 is self-learning. From the trip intervals of preceding actuations of the actuating element 8, the control electronics 6 determines the rhythm in which the operating person performs the metering. This is then used to determine the process interval $t_p$. The operating person himself need not set the process interval $t_p$ on the programming element 9, but instead, the process interval $t_p$ is set automatically to comply with the operating rhythm of the operating person.

A first possibility of determining the process interval $t_p$ is that the trip interval of the last person performing the metering operation is accepted by the control electronics 6 as the process interval $t_p$ before the start of continuous actuation of the actuating element 8.

Figure 4:
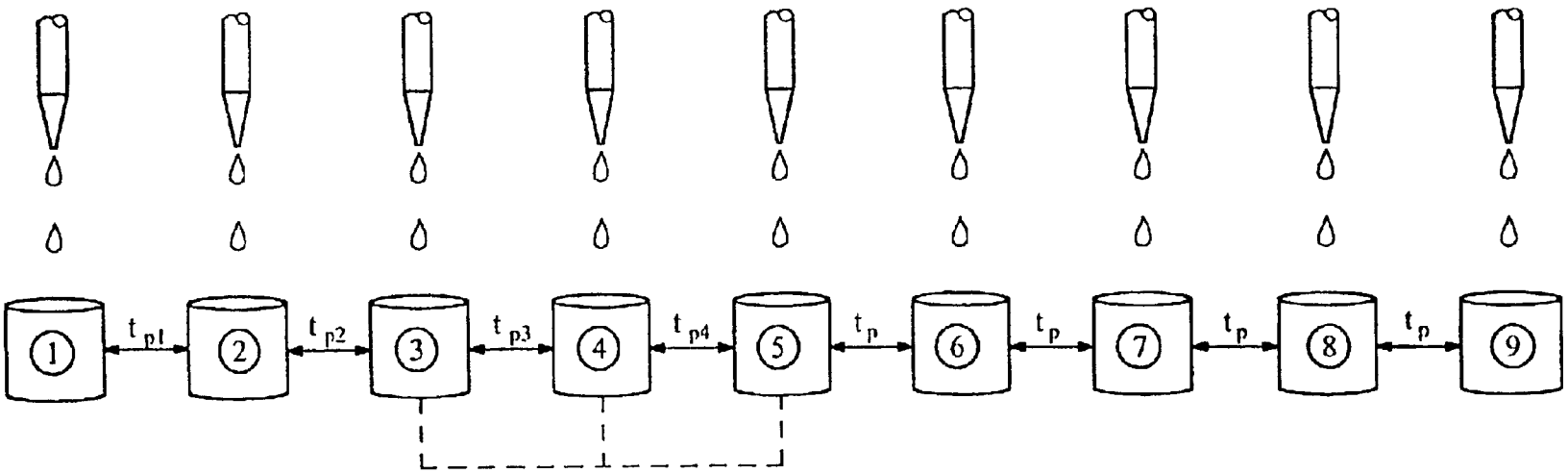
FIG. 4 shows a flow chart illustrating the operation of a preferred embodiment of a repeating pipette.

FIG. 4 shows a flow chart which illustrates another preferred embodiment of the dispensing device D in accordance with the present invention. An average of the last n trip intervals (n>1), for instance, the last two trip intervals, before the start of continuous actuation of the actuating element 8, is accepted by the control electronics 6 as the process interval $t_p$. In the extreme, n may simply comprise all individual metering operations that have taken place previously. The flow chart in FIG. 4 shows individual metering operations 1, 2, 3, 4, 5, where automatic triggering of metering begins with step 6 and continues over steps 7, 8, 9. The last two trip intervals, namely $t_{p3}$ and $t_{p4}$ here, are detected before the start of continuous actuation of the actuating element 8 in metering step 5. This is indicated by the dotted line.

The desired averaging may be performed purely arithmetically, i.e., according to the formula $t_p=(t_{p3}+t_{p4})./.2$. In averaging, however, the intervals of the last n individual metering operations may also be weighted. This may take place, for example, in that the last three individual metering operations are detected on the whole, but in averaging, the interval between the last individual metering operation and the next-to-last individual metering operation is weighted double. In this analysis, it is also assumed that the process interval $t_p$ is obtained directly from the trip interval so that no conversion or correction is necessary to this regard. It should also be noted that the drawing in FIG. 4 might be interpreted to indicate that only the resting interval is measured. This is of course not the case, and the drawing is intended only to describe the process interval $t_p$, i.e., the period of time between the start of one process step and the start of the next process step.

One possibility of analyzing the individual metering operations by using the control electronics 6 also includes having the control electronics 6 determine an average of a plurality of individual metering operations before the start of automatic metering according to a statistical method of analysis. Such a statistical method of analysis can also detect groups of individual metering operations with an interval between them in a longer learning phase. One possibility of implementation of statistical analysis is a filter in the control electronics 6 to eliminate atypically large intervals and/or atypically small intervals.

The control electronics 6 of the dispensing device D according to this invention may also be designed so that a previously determined process interval $t_p$ (or a process interval $t_p$ accepted due to continuous actuation of the actuating element 8) remains stored in the control electronics 6 until optional active deletion and/or until the dispensing device D is shut down. The stored process interval $t_p$ may then become active again on renewed continuous actuation of the actuating element 8. Thus, once the process interval $t_p$ has been determined, it is maintained even if the metering activity is interrupted, so that an operating person can maintain his or her rhythm once it has been found.

Active deletion of the stored process interval $t_p$ is attained through operation of a programming key 11 of the programming element 9 and/or by renewed multiple individual metering operations. By performing multiple individual metering operations, the operating person is signaling to the control electronics 6 that the operating person desires a new determination of the process interval $t_p$. The operating person may have also changed, and the new operating person would like to find his or her own rhythm and have it taken into account in the determination and setting of the process interval $t_p$. This purpose is also served by this design of the control electronics 6.

It has been found that the intervals between the individual actuations of the actuating element 8 in a single metering operation are slightly larger/longer than the intervals occurring with continuous actuation of the actuating element 8 via in automatic metered actuation due to the time required for actuation of the actuating element 8 itself in single metering operation. This effect can also be taken into account and compensated through electronic control technology by the fact that the process interval $t_p$ actually used is set and/or stored by the control electronics 6 to be somewhat shorter than the process interval $t_p$ determined by the control electronics 6 from the previous individual metering operations. A similar effect is achieved when there is little or no consideration is given to the net-actuation time for actuating element 8 in determination of the process interval $t_p$. The result is that the process interval $t_p$ is shorter than the trip interval on the basis of which the process interval $t_p$ was determined. In particular in the case of mechanical actuating elements 8, this differentiation is important for the reasons explained above.

The process interval $t_p$ can be corrected in the sense explained above by using a correction factor, preferably a fixed preset correction factor. The choice of the correction factor and the accuracy of the determination of process interval $t_p$ on the whole is, of course, determined in general by the accuracy in setting the process interval $t_p$. If only setting increments of 0.1 sec are possible anyway, then larger error would be possible than if a smaller division for the setting steps of the process interval $t_p$ were available in the control electronics.

A change in the actuating rhythm of the operating person after beginning continuous actuation of the actuating element 8 can also be taken into account by having the control electronics detect the cycle of movement of the dispensing device D even in continuous actuation of the actuating element 8, and use the detected cycle of movement to correct the process interval $t_p$. Since in this case, actuation of the actuating element 8 itself can no longer be used as an input for the control electronics 6, the movement of the dispensing device D by the operating person from one receiving vessel 12 to another receiving vessel 12 should be detected. For example, this can be accomplished by an acceleration sensor which detects the sideways movement of the dispensing device D by analysis of the transverse acceleration, and its signal is analyzed by the control electronics 6 accordingly.

There are different advantageous embodiments for the first type of actuation of the actuating element 8 and the second type of actuation of the actuating element 8. The combination of a short-term actuation and continuous actuation of the actuating element 8 has already been proposed in the state of the art.

As already explained above, it has been found to be especially advantageous to design the actuating element 8 not as a mechanical element, but instead, as an element that operates purely electronically, preferably as a proximity-type element. In particular an optoelectronic actuating element 8 such as that illustrated in the detail in FIG. 1 with an opto-transmitter 8' and an opto-receiver 8" on a transmission link covered by a deformable or movable cover 8'" is especially advantageous and expedient from the standpoint of analytical technology and with regard to analytical software. In this regard, the optoelectronic actuating element 8 may include a photoelectric barrier element and/or a light reflection element.

The features of an especially preferred embodiment of a device according to this invention which are explained above can also be implemented in aspirating devices or combined dispensing and aspirating devices for liquids as mentioned above repeatedly, the present invention being correspondingly adapted for use in such applications.

On the whole, the dispensing device D according to the example embodiment of the present invention with the self-learning control electronics 6 creates a user-friendly system with which extensive work with a hand-operated device such as the repeating pipette 1 can be carried out comfortably and in a manner that is convenient for the individual so that the work can be completed extremely rapidly.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. A device for conveying a liquid including at least one of dispensing and aspirating the liquid comprising:

a controlling device adapted to convey the liquid;

a motor drive for operating the controlling device;

control electronics for controlling the motor drive and for setting at least one process interval ($t_p$) for a plurality of process steps to be carried out in succession;

a manually actuatable actuating element connected to the control electronics to allow actuation of the control electronics to convey the liquid; and a programming element for programmining the control electronics to adjust control of the motor drive to thereby adjust the quantity of liquid conveyed upon actuation of the actuating element;

wherein a first type of actuation of the actuating element manually triggers an individual process step, and a second type of actuation of the actuating element automatically causes automatic repeated successive triggering of process steps, each in the process interval ($t_p$); and wherein the process interval ($t_p$) is determined by the control electronics by analyzing at least one interval occurring between manual actuations of the actuating element.

2. The device according to claim 1, wherein the device is a repeating pipette of a pipette system with a syringe interchangeably mounted thereon, the repeating pipette being at least one of a positive displacement and an air displacement type.

3. The device according to claim 1, wherein the device is a metering device of a metering system with a metering liquid storage container, the metering device being at least one of a positive displacement and an air displacement type.

4. The device according to claim 1, wherein interval from last manual individual triggering before start of automatic triggering is set as the process interval ($t_p$) by the control electronics.

5. The device according to claim 1, wherein an average of last n intervals (n>1) from manual individual triggering before start of automatic triggering is set as the process interval ($t_p$) by the control electronics.

6. The device according to claim 1, wherein the last n intervals of manual individual triggerings are weighted.

7. The device according to claim 1, wherein an average of a plurality of manual individual triggerings before the start of automatic triggering is determined by the control electronics based on a statistical method of analysis.

8. The device according to claim 7, wherein the control electronics includes a filter for eliminating at least one of atypically large and atypically small intervals.

9. The device according to claim 1, wherein the process interval ($t_p$) is stored in the control electronics and is active on renewed actuation of the actuating element until the proccess interval is at least one of actively deleted and the device is turned off.

10. The device according to claim 9, wherein the stored process interval ($t_p$) is actively deleted by at least one of actuation of the programming element and renewed multiple manual individual triggerings.

11. The device according to claim 1, wherein the stored process interval ($t_p$) is actively deleted by at least one of actuation of the programming element and renewed multiple manual individual triggerings.

12. The device according to claim 1, wherein the process interval ($t_p$) set by the control electronics is shorter than the process interval ($t_p$) determined by the control electronics from the preceding manual individual triggerings.

13. The device according to claim 12, wherein the process interval ($t_p$) determined by the control electronics from the preceding manual individual triggerings is corrected using a correction factor applied to the process interval ($t_p$) stored by the control electronics.

14. The device according to claim 1, wherein during the second type of actuation, the control electronics also detects cycle of movement of the device between the triggering operations and uses the cycle of movement to correct the process interval ($t_p$).

15. The device according to claim 14, wherein the control electronics includes a sensor adapted to sense movement of the device between the triggering operations.

16. The device according to claim 1, wherein the first type of actuation of the actuating element is a short-term actuation, and the second type is a continuous actuation.

17. The device according to claim 1, wherein the actuating element is actuated by depressing an actuating key.

18. The device according to claim 16, wherein the actuating element is actuated by depressing an actuating key.

19. The device according to claim 17, wherein the actuating element is actuated by releasing an actuating key that has previously been depressed.

20. The device according claim 1, wherein the actuating element is a double element having a first element for individual triggering and a second element for automatic triggering.

21. The device according claim 17, wherein the actuating element is a double element having a first element for individual triggering and a second element for automatic triggering.

22. The device according to claim 1, wherein the actuating element is actuated once for single actuation and double actuated for continuous actuation.

23. The device according to claim 1, wherein the actuating element is an electronic element.

24. The device according to claim 23, wherein the actuating element is an optoelectronic element.

25. The device according to claim 24, wherein the actuating element includes at least one of a photoelectric barrier element and a light reflection element.

26. The device according to claim 23, wherein the actuating element is a proximity-type element.

* * * * *